United States Patent [19]

Heybourne et al.

[11] Patent Number: 4,965,015

[45] Date of Patent: Oct. 23, 1990

[54] DETERGENT COMPOSITION AND PROCESS FOR ITS PRODUCTION

[75] Inventors: Michael J. H. Heybourne, Hertfordshire; Peter C. Knight, South Wirral, both of England; Antonio Malguzzin, Milan; Daniele Miotti, Piacenza, both of Italy; Andrew W. Travill, deceased, late of Wirral, England, by Travill Rachel May, legal representative

[73] Assignee: Lever Brothers Company, New York, N.Y.

[21] Appl. No.: 425,495

[22] Filed: Oct. 17, 1989

Related U.S. Application Data

[63] Continuation of Ser. No. 97,007, Sep. 14, 1987, abandoned.

[30] Foreign Application Priority Data

Sep. 19, 1986 [GB] United Kingdom ..... 8622565

[51] Int. Cl.[5] ..... C11D 7/14; C11D 11/02; C11D 17/06; C22D 1/14

[52] U.S. Cl. ..... 252/174.25; 252/131; 252/135; 252/140; 252/174.21; 252/530; 252/549; 23/313 AS

[58] Field of Search ..... 252/135, 140, 174.25, 252/174.13; 23/313 AS

[56] References Cited

U.S. PATENT DOCUMENTS 4,534,880 8/1985 Kosal et al. ..... 252/174.13
4,818,424 4/1989 Evans et al. ..... 252/135

FOREIGN PATENT DOCUMENTS 87035 8/1983 European Pat. Off. .

*Primary Examiner*—Paul Lieberman
*Assistant Examiner*—J. E. Darland
*Attorney, Agent, or Firm*—Ronald A. Koatz

[57] ABSTRACT

A process for producing aluminosilicate-built spray-dried detergent powders containing silicate comprises spraying a detergent slurry containing aluminosilicate into a spray-drying tower and simultaneously spraying in an aqueous solution of sodium silicate The resulting powders contain characteristic composite granules.

4 Claims, 1 Drawing Sheet

DETERGENT COMPOSITION AND PROCESS FOR ITS PRODUCTION

This is a continuation application of Ser. No. 097,007, filed Sept. 14, 1987, now abandoned.

TECHNICAL FIELD OF INVENTION

The present invention relates to detergent powders containing alkali metal aluminosilicate builder, and also containing appreciable levels of alkali metal silicate, and to the preparation of those powders by spray-drying.

BACKGROUND AND PRIOR ART

Alkali metal aluminosilicates, both crystalline (zeolites) and amorphous, are effective detergency builders which can be used to replace sodium tripolyphosphate (STP) in detergent powders, but they do not possess an ability comparable to that of STP to contribute to the structure of a spray-dried powder. Alkali metal silicates are frequently included in detergent powders as structurants, to reduce washing machine corrosion and to increase alkalinity. It is well known, however, that if aluminosilicate and silicate are together in a detergent slurry they can interact unfavourably: agglomeration of the aluminosilicate occurs to give powders containing large particles which are slow to disperse in the wash liquor, giving reduced washing performance.

U.S. Pat. No. 4,129,511 (Lion) discloses a method of making a detergent composition containing 5 to 20% sodium silicate and 0.5 to 5% aluminosilicate by subjecting a detergent slurry containing silicate and an aluminosilicate slurry to spray-drying separately within the same drying space.

GB No. 2 013 707B (Unilever) discloses a process in which an aqueous solution or dispersion of sodium silicate is injected into a silicate-free or low-silicate, aluminosilicate-containing detergent slurry after it leaves the crutcher but before atomisation at the spray-nozzle. This measure reduces the time of contact between silicate and aluminosilicate in the slurry, but does not eliminate such contact.

EP No. 10 247B (Henkel KGaA) discloses a process in which silicate is omitted from the slurry, and instead is subsequently admixed as a solid with the spray-dried powder. The slurry contains aluminosilicate, surfactant and certain organic sequestrant builder materials, while the silicate is postdosed in the form of a powder having a $Na_2O:SiO_2$ mole ratio of 2.0 to 2.2, a water content of 15–23% by weight and a high water solubility. Other ingredients unsuitable for spray-drying, for example, certain nonionic surfactants, may also be postdosed.

Powders made by this process exhibit improved washing performance, since the aluminosilicate is carried through into the powder, and into the wash, in the form of small particles. The physical properties of these powders tend, however, to be poor and the powder strength low.

Our European Patent Application No. 87 302 911.0 filed Apr. 3, 1987 discloses an improved process wherein solid sodium silicate is postdosed to a spray-dried base powder containing an additional powder structurant which is a polymeric material. Our European Patent Application No. 87 303 159.5 filed on Apr. 10, 1986 discloses and claims a similar process wherein the spray-dried base powder contains a succinic acid salt as an additional structurant.

In these processes involving postdosing of solid sodium silicate to a spray-dried base powder, it is essential that the sodium silicate be of high quality and have rapid dissolution characteristics: such high-grade sodium silicate is expensive. Handling of this rather dusty material in the factory can also cause safety problems.

We have now discovered an alternative process for introducing sodium silicate into aluminosilicate-built powders while avoiding contact, and unfavourable interaction, between the two components in the slurry. The process results in powders containing characteristic composite granules.

DEFINITION OF THE INVENTION

The present invention provides a process for the production of a spray dried detergent composition comprising the steps of (i) spraying into a spray-drying tower a slurry comprising a crystalline or amorphous alkali metal aluminosilicate and one or more anionic or nonionic detergent active compounds and (ii) simultaneously spraying an aqueous solution of alkali metal silicate separately into the tower, whereby droplets of the alkali metal silicate solution encounter slurry droplets and/or powder granules formed therefrom to form composite granules.

The present invention further provides a spray-dried granular detergent composition including composite granules consisting essentially of:

(i) a core granule comprising crystalline or amorphous alkali metal aluminosilicate and one or more anionic and/or nonionic detergent-active compounds, and (ii) an outer layer, in the form of a coating or of smaller particles, comprising alkali metal silicate.

DESCRIPTION OF THE INVENTION

In its first aspect, the present invention is concerned with a spray-drying process. A detergent slurry containing normal base powder ingredients, including detergent-active compounds and crystalline or amorphous alkali metal (preferably sodium) aluminosilicate, is atomised in the normal manner in a spray-drying tower. Generally the slurry is sprayed downwardly from one or more nozzles situated in the upper part of the tower, while hot air is blown upwardly from a ring main situated near the base of the tower. As the slurry droplets descend they rapidly lose moisture to form granules, which are initially wet and sticky but become progressively less so as they fall, until at the collection point at the base of the tower they are relatively dry. The nozzles from which the slurry is sprayed may be of any suitable type, for example, swirl and tip nozzles.

Simultaneously, an aqueous solution of alkali metal (preferably sodium) silicate is sprayed separately into the tower from a separate nozzle or set of nozzles. Like those used for the slurry, these may be of any suitable type, for example, swirl and tip nozzles.

The relative positions of the two nozzles or sets of nozzles appears not to be critical, nor does the direction in which the silicate solution is sprayed in relation either to the direction of spray-in of the slurry (which is generally, but not necessarily, downward) or to the direction of the hot air flow, which is normally upward. Whatever the arrangement chosen, the aim is to maximise the probability of collisions between the droplets of silicate solution and the slurry droplets or base powder granules. It should also be remembered that the wetter the slurry droplets or base powder granules when collisions occur, the greater the chance of the formation of composite granules.

One arrangement that has been found to be satisfactory, when the slurry is sprayed downwardly from a position near the top of the tower, is for the silicate solution to be sprayed upwardly from a level lower than that from which the slurry is sprayed. In this arrangement, the distance between the levels at which the two components enter the tower can apparently vary quite widely. Distances from 1.0 to 4.5 meters have been found to give satisfactory powders, although the granules making up these powders differ depending on the separation, as discussed below. Alternatively, the distance between the hot air inlet and the spray-in level for the silicate may be considered: distances of from 2.5 to 5.0 meters have been found to be satisfactory.

In principle, many other arrangements could be adopted. For example, the two components could both be sprayed in the same direction—preferably downwards—from the same level; or the silicate spray-in position might be higher than that of the slurry spray-in, with downward spraying of the silicate solution. The essential feature of the invention, which distinguishes it from the process of the aforementioned GB No. 2 013 707B, is that mixing of the two components does not occur until after each has been separately atomised.

Advantageously the temperature of the sprayed-in sodium silicate solution is not higher than ambient (say 30° C.): this slows down the rate of drying of the silicate. A low atomising pressure is also advantageous in giving larger droplets. Both these measures increase the probability of collisions leading to the formation of composite granules.

Detergent powders prepared by the process of the invention are characterised by the presence of composite granules which are readily recognisable, and quite different from the particles produced from processes in which sodium silicate is incorporated via the slurry, or from processes in which sodium silicate is postdosed as a solid. The composite granules are composed of a core of base powder derived from the slurry, and an outer layer, generally in the form of a partial or complete coating or of discrete smaller particles, of sodium silicate. Thus detergent powders containing such composite granules constitute the second aspect of the present invention.

The structure and constitution of the composite granules will vary according to the relative positions of the slurry spray-in, the silicate spray-in and the hot air inlet; the directions of the sprays in relation to each other and to the direction in which hot air is travelling; the type of atomiser used and the atomising pressure; and the inlet temperature of the silicate solution. Under conditions in which the silicate solution dries slowly and contacts the base powder particles while still liquid, a preponderance of coated particles is obtained. For example the proportion of composite granules can be increased by moving the silicate spray-in nozzle. The homogeneity of the product is also increased thereby. A homogeneous product is somewhat preferable to a heterogeneous product, but both are acceptable and within the scope of the present invention. Under conditions in which the silicate solution dries fast, or dries before the droplets contact the base powder particles, a relatively high proportion of separate base powder granules and silicate particles, the latter generally in the form of hollow glassy spheres, will be obtained. There will, however, also be some agglomerates present in which relatively small silicate particles are clustered around larger base powder granules. These various structures are readily detectable by electron or photomicrography.

A typical composite particle may contain from 2 to 15% by weight of sodium silicate.

The slurry used in the process of the invention to form a base powder will generally contain any heat-insensitive ingredients to be incorporated in the product. These include the alkali metal aluminosilicate builder, which may suitably be present in an amount of from 10 to 60% by weight, based on the final powder. The alkali metal (preferably sodium) aluminosilicates used in the process and compositions of the invention may be either crystalline or amorphous or mixtures thereof, and they have the general formula $$0.8\text{–}1.5\ Na_2O.Al_2O_3.0.8\text{–}6\ SiO_2.$$

These materials contain some bound water and are required to have a calcium ion exchange capacity of at least about 50 mg CaO/g. The preferred sodium aluminosilicates contain 1.5–3.5 $SiO_2$ units (in the formula above) and have a particle size of not more than about 100 μm, preferably not more than about 20 μm and especially not more than 10μm. Both the amorphous and crystalline sodium aluminosilicates can be made readily by reaction between sodium silicate and sodium aluminate, as amply described in the literature.

Suitable crystalline sodium aluminosilicate ion-exchange detergency builders are described, for example, in GB No. 1 473 201 (Henkel) and GB No. 1 429 143 (Procter & Gamble). The preferred sodium aluminosilicates of this type are the well-known commercially available zeolites A and X, and mixtures thereof.

Other builders may also be included in the compositions of the invention if necessary or desired: suitable organic or inorganic water-soluble or water-insoluble builders will readily suggest themselves to one skilled in the art, and include alkali metal phosphates, for example, sodium orthophosphate, pyrophosphate or tripolyphosphate; alkali metal carbonate; monomeric or polymeric polycarboxylates, for example, alkali metal citrate, nitrilotriacetate, polyacrylate or acrylic copolymers. The invention is of especial applicability to compositions containing reduced or zero levels of phosphate, for example, less than 6% by weight, preferably less than 2.5% by weight, calculated as phosphorus.

Other inorganic salts without a detergency building function, for example, sodium sulphate, may also be includes in the slurry.

The slurry will also contain one or more anionic and/or nonionic surfactants.

Anionic surfactants are well known to those skilled in the detergents art. Examples include alkylbenzene sulphonates, particularly sodium linear alkylbenzene sulphonates having an average chain length of about $C_{12}$; primary and secondary alcohol sulphates, particularly sodium $C_{12}$–$C_{15}$ primary alcohol sulphates; olefin sulphonates; alkane sulphonates; and fatty acid ester sulphonates.

Nonionic surfactants that may be used in the process and compositions of the invention include the primary and secondary alcohol ethoxylates, especially the $C_{12}$–$C_{15}$ primary and secondary alcohols ethoxylated with an average of from 3 to 20 moles of ethylene oxide per mole of alcohol.

It may also be desirable to include one or more soaps of fatty acids. The soaps which can be used are preferably sodium soaps derived from naturally occurring fatty acids, for example the fatty acids from coconut oil, beef tallow, or sunflower oil.

The total amount of detergent-active material (surfactant), excluding soap, in the detergent powders of the invention is preferably within the range of from 5 to 40% by weight. For powders intended for use in European front-loading automatic washing machines the preferred range is from 5 to 20% by weight, with a weight ratio of anionic surfactant to nonionic surfactant not exceeding 10:1, and more preferable not exceeding 6:1.

To exploit to the full the benefits of the present invention, it is preferred that the slurry be substantially free of alkali metal silicate, so that all silicate required in the product is introduced by spraying-in. The slurry conveniently contains no more than 4% by weight (final powder basis) of silicate; preferably the slurry contains 2% or less by weight (final powder basis) of silicate. Inclusion of more silicate in the zeolite slurry tends to give unacceptably high levels of slowly dispersing agglomerates as explained previously.

If anionic and nonionic surfactants are both present in the slurry at a weight ratio (dry weight basis) of 6:1 or less, the silicate content in the slurry preferably does not exceed 1% by weight (final powder basis): when the anionic to nonionic ratio is higher, slightly higher levels of silicate can be tolerated.

The slurry will generally also contain the heat-insensitive minor ingredients conventionally incorporated in this manner, for example, antiredeposition agents, antiencrustation agents and fluorescers.

It is also within the scope of the invention for some of these heat-insensitive ingredients to be incorporated via the aqueous silicate solution instead of, or as well as, via the slurry. For example, anionic surfactants such as linear alkylbenzene sulphonate, and dyes may be included in the silicate liquor.

Unlike the hitherto known processes for introducing silicate into an aluminosilicate containing detergent composition it is not necessary to use expensive, high quality solid silicate. Almost any normal type including commercially available water-glass may be employed. The sodium silicate is preferably not too alkaline, very alkaline silicates tend to give sticky detergent powders that cake badly on storage. Sodium silicates are often referred to by the so-called 'r' number; the mole ratio of silica to sodium oxide ($Na_2O$). Preferably 1.5 r to 3.3 r sodium silicate is used, and normal alkaline (2 r) sodium silicate is preferred. We have found, however, that silicates having a higher ratio of silica to sodium oxide, for example neutral, 3.3 r, sodium silicate or 2.6 r sodium silicate can give the surprising technical benefit of better storage stability. In particular such silicates lead to powders with a reduced tendency to cake on storage. Furthermore, when used to produce high-bulk density powders, i.e. those having a bulk density in excess of about 450 $kgm^{-3}$, The tendency for bulking density to reduce on storage is reduced or eliminated. However, these products may give powders with more insolubles than the alkaline silicates.

The concentration of the aqueous sodium silicate solution may range, for example, for 20 to 50% by weight, preferably from 30 to 45% by weight.

The amount of sodium silicate in the final powder is suitably within the range of from 2 to 15% by weight, preferably from 2.5 to 6% by weight.

Any heat-sensitive ingredients required to be incorporated in the compositions of the invention may be postdosed to, or sprayed onto, the spray-dried powder in the conventional manner. Such ingredients are well-known to those skilled in the art and include bleaches, bleach precursors and bleach stabilisers, enzymes, suds suppressors, liquid nonionic surfactants, perfumes and dyes.

DESCRIPTION OF DRAWINGS

The process of the invention will now be described in more detail, by way of example only, with reference to the accompanying drawings, in which

Referring now to FIG. 1 of the accompanying drawings, a spray-drying tower indicated generally by the reference numeral 1 contains near its top a first set of spray nozzles 2 fed by a line 3. The nozzles 2 point downwards. A second set of spray nozzles 4, pointing upwards, are positioned a substantial distance, for example, 4.4 m, below the first set 2. The nozzles 4 are fed by a line 5. A ring main 6 for hot air is positioned near the base of the tower.

Figure 1:
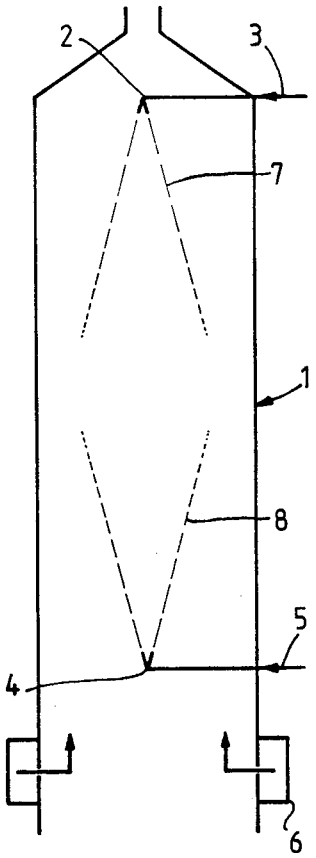
FIG. 1 represents a schematic vertical section of a first spray-drying tower adapted for use in accordance with the invention.

The process of the invention is carried out as follows. An aqueous slurry containing the base powder ingredients, including zeolite and detergent active compounds, is pumped along the line 3 to the nozzles 2 where it is sprayed downwards, the atomised droplets forming a hollow cone indicated by the dotted line 7. An aqueous solution of sodium silicate, optionally containing other ingredients, is pumped along lines 5 to the nozzles 4 where it is sprayed upwards, the atomised droplets forming a hollow cone indicated by the dotted line 8. Droplets of silicate solution collide with descending wet, sticky granules of base powder formed by the drying of the slurry droplets and some composite granules are formed. Other silicate solution droplets which fail to collide with base powder granules are simply dried to form glassy hollow spheres. Composite granules, silicate spheres and base powder granules fall to the base of the tower and are collected there.

Figure 2:
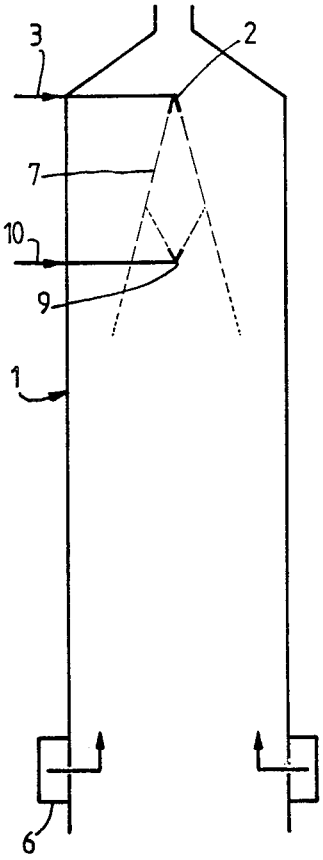
FIG. 2 represents a schematic vertical section of a second spray-drying tower adapted for use in accordance with the invention.

A variant of this process may be carried out using the tower shown in FIG. 2 of the accompanying drawings. This differs from the tower of FIG. 1 in that its second set of nozzles 9 is substantially closer to, for example, 1.0 m from, the first set 2. The nozzles 9 are fed by a line 10. As with the tower of FIG. 1, slurry is pumped to the nozzles 2 and sprayed downwards, while aqueous sodium silicate solution is pumped to the nozzles 9 and sprayed upwards, forming a hollow cone indicated by the dotted line 11. A powder containing a larger proportion of composite granules is obtained in this second process variant.

As previously indicated, may other possible arrangements within the spray-drying tower can be envisaged as alternatives to the two just described.

EXAMPLES

The invention is further illustrated by the following non-limiting Examples.

EXAMPLES 1 & 2

A detergent slurry was prepared to the following composition (in parts by weight):

| | |
|---|---|
| Linear alkylbenzene sulphonate (Na salt) | 9.0 |
| Nonionic surfactant | 1.0 |
| Polycarboxylate polymer | 4.0 |
| Zeolite (Na) | 24.0 |
| Sodium sulphate | 25.0 |
| Minor ingredients | 1.0 |
| Water | 45.0 |

Three powders were prepared by spray-drying. A control powder A was prepared by spray-drying the slurry specified above without spraying in silicate; the final powder contained 9.0 parts of water.

A first powder 1 according to the invention was prepared by spraying in aqueous sodium silicate solution (60% water content), to a level of 2.5 parts of sodium silicate (final powder basis). A second powder 2 according to the invention was prepared similarly, to contain 4.0 parts by weight of sodium silicate. In each case 2.0 r sodium silicate was used, The physical properties of the powders were as follows:

| | A | 1 | 2 |
|---|---|---|---|
| Bulk density (g/liter) | 400 | 406 | 400 |
| Dynamic flow rate D (ml/s) | 83 | 86 | 90 |
| Compressibility C (% v/v) | 38 | 32 | 29 |
| "Flow figure" D–C | 45 | 54 | 61 |

The improvement in flow properties with increasing silicate content will noted.

The "insolubles" obtained when the powders were dispersed in water were also tested: the results are shown below, expressed as the percentage of particles >120 μm obtained when each powder had been agitated in water of the specified temperature for 2 minutes.

| | A | 1 | 2 |
|---|---|---|---|
| Fresh powder | | | |
| 20° C. | 0.1 | 0.4 | 1.0 |
| 40° C. | 0.6 | 0.2 | 0.1 |
| Stored powder | | | |
| 20° C. | 0.0 | 1.5 | 4.7 |
| 40° C. | 0.0 | 1.4 | 5.2 |

In comparison, another control powder B, prepared by postdosing 5.0 parts by weight of solid sodium silicate Al (ex Crosstield) to the base powder described above, gave insolubles values of 4–5% for fresh powder at both 20° C. and 40° C.

Finally, the tendency of the powders to corrode aluminium was tested: sodium silicate in detergent powders prevents the corrosion of washing machine surfaces, but can only be effective in doing so if present in a water-soluble form. The results, expressed as the percentage weight loss per hour of an aluminium disc immersed in a solution of each powder at the specified concentration, are shown below.

| | A | 2 | B |
|---|---|---|---|
| 5 g/liter | 0.22 | 0.20 | 0.18 |

-continued

| | A | 2 | B |
|---|---|---|---|
| 10 g/liter | 0.45 | 0.02 | 0.01 |

It will be seen that the powder 2 prepared in accordance with the invention gave as little corrosion as did the powder B containing the postdosed sodium silicate that had not been subjected to any processing steps.

EXAMPLES 3 to 6

Detergent slurries were prepared to the following composition.

| | 3 | 4 | 5 | 6 |
|---|---|---|---|---|
| Linear alkylbenzenesulphonate (Na salt) | 9.0 | 9.0 | 9.0 | 9.0 |
| Nonionic surfactant | 1.0 | 1.0 | 1.0 | 1.0 |
| Polycarboxylate polymer | 4.0 | 4.0 | 4.0 | 4.0 |
| Zeolite (Na) | 24.0 | 24.0 | 24.0 | 24.0 |
| Sodium carbonate | 20.0 | 2.0 | 2.0 | 2.0 |
| Alkaline silicate (1:2) | 0.0 | 0.0 | 0.0 | 0.75 |
| Minor ingredients | 1.0 | 2.0 | 2.0 | 2.0 |
| Water | 10.0 | 10.0 | 10.0 | 10.0 |
| Total Parts | 69.0 | 52.0 | 52.0 | 52.75 |

In Example 3 the alkylbenzenesulphonate was added as the sulphonic acid. It reacted with some of the sodium carbonate so that sodium sesquicarbonate was formed in the slurry as described in our European Patent Application No. 87 303 147.0 filed Apr. 10, 1987. Theoretically, this produced approximately 5.8 parts of sodium sesquicarbonate.

Each slurry was co-sprayed with neutral (3.3 r) sodium silicate containing Monastral blue dye as follows:

| | 3 | 4 | 5 | 6 |
|---|---|---|---|---|
| Total parts (as dry powder) detergent slurry | 69.0 | 52.0 | 52.0 | 52.75 |
| Co-sprayed neutral silicate | 5.0 | 5.0 | 10.0 | 5.0 |
| Total parts powder | 74.0 | 57.0 | 62.0 | 57.75 |

In each case the parts are quoted on an anhydrous basis.

The bulk density of each powder was measured both immediately after spray-drying and on storage for 12 weeks at 28° C. and 70% relative humidity. The following results were obtained:

| | 3 | 4 | 5 | 6 |
|---|---|---|---|---|
| Initial bulk density ($kgm^{-3}$) | 460 | 490 | 510 | 485 |
| Bulk density after storage ($kgm^{-3}$) | 460 | 500 | 490 | 480 |
| Decrease in bulk ($kgm^{-3}$) density on storage | 0 | −10 | 20 | 5 |

A similar powder having a bulk density of about 500 $kgm^{-3}$ and prepared by post-dosing alkaline silicate (2 r) would show a decrease of about 70 $kgm^{-3}$ on storage. The compositions of the present invention show little change.

We claim:

1. A process for the production of a spray-dried detergent powder comprising crystalline or amorphous alkali metal aluminosilicate, and one or more anionic or nonionic detergent active compounds which process comprises the steps of (i) spraying into a spray-drying tower an aqueous slurry comprising a crystalline or amorphous alkali metal aluminosilicate and 5 to 40% by weight of final powder of one or more anionic or nonionic detergent active compounds, and (ii) simultaneously spraying an aqueous solution of alkali metal silicate separately into the tower, which solution contains at least 20% by weight of alkali metal silicate, whereby droplets of the alkali metal silicate solution encounter droplets of the slurry, or powder so as to form composite granules with alkali metal silicate at the exterior thereof.

2. A process as claimed in claim 1 wherein the slurry is sprayed downwardly and the alkali metal silicate solution is sprayed upwardly from a position below the level at which the slurry is sprayed.

3. A process as claimed in claim 1 wherein the temperature of the sprayed in alkali metal silicate solution is 30° C. or lower.

4. Process according to claim 1 wherein said alkali metal aluminosilicate constitutes from 10 to 60% by weight of the final powder.

* * * * *